US007363985B2

(12) United States Patent
Heinonen et al.

(10) Patent No.: US 7,363,985 B2
(45) Date of Patent: Apr. 29, 2008

(54) HYDRAULIC LATCH FOR CAPILLARY TUBING STRING

(75) Inventors: Robert L. Heinonen, Dallas, TX (US); John M. Allen, Duncanville, TX (US)

(73) Assignee: Double-E Inc., Dallas, TX (US)

( * ) Notice: Subject to any disclaimer, the term of this patent is extended or adjusted under 35 U.S.C. 154(b) by 298 days.

(21) Appl. No.: 11/286,807

(22) Filed: Nov. 23, 2005

(65) Prior Publication Data

US 2007/0114042 A1 May 24, 2007

(51) Int. Cl.
*E21B 23/02* (2006.01)

(52) U.S. Cl. ..... 166/382; 166/242.6; 166/377; 166/380

(58) Field of Classification Search ..... None
See application file for complete search history.

(56) References Cited

U.S. PATENT DOCUMENTS

| | | | | |
|---|---|---|---|---|
| 1,641,921 | A | | 9/1927 | Crowell |
| 2,458,270 | A | | 1/1949 | Humason |
| 3,478,826 | A | | 11/1969 | Barnes |
| 3,675,719 | A | | 7/1972 | Slator et al. |
| 3,692,107 | A | | 9/1972 | Slator et al. |
| 3,955,822 | A | | 5/1976 | Irby |
| 3,967,678 | A | | 7/1976 | Blackwell |
| 4,051,899 | A | * | 10/1977 | Fredd ..... 166/217 |
| 4,078,810 | A | | 3/1978 | Arendt |
| 4,286,791 | A | | 9/1981 | McLean |
| 4,289,294 | A | | 9/1981 | McLean |
| 4,345,766 | A | | 8/1982 | Turanyi |
| 4,354,304 | A | | 10/1982 | Dixon |
| 4,515,213 | A | | 5/1985 | Rogen et al. |
| 4,522,368 | A | | 6/1985 | Sable |
| 4,541,490 | A | | 9/1985 | Bigbie et al. |
| 4,545,434 | A | * | 10/1985 | Higgins ..... 166/217 |
| 4,600,054 | A | | 7/1986 | Miller et al. |
| 4,665,976 | A | | 5/1987 | Retherford |
| 4,690,411 | A | | 9/1987 | Van Winkle |
| 4,723,606 | A | * | 2/1988 | Vinzant et al. ..... 166/319 |
| 4,762,473 | A | | 8/1988 | Tieben |
| 4,844,406 | A | | 7/1989 | Wilson |
| 4,907,650 | A | | 3/1990 | Heinonen |
| 4,927,112 | A | | 5/1990 | Wilson |
| 5,044,602 | A | | 9/1991 | Heinonen |
| 5,058,668 | A | | 10/1991 | Newton |
| 5,092,400 | A | | 3/1992 | Jagert |
| 5,148,699 | A | | 9/1992 | Morse |
| 5,150,751 | A | | 9/1992 | Burton et al. |
| 5,246,067 | A | | 9/1993 | Heinonen et al. |
| 5,522,464 | A | | 6/1996 | Piper |
| 5,860,478 | A | | 1/1999 | Coutts et al. |

(Continued)

OTHER PUBLICATIONS

Barton Industries, Inc.; "Bartech: Stuffing Box Leak Detection System"; 1991, 2 pages.

(Continued)

*Primary Examiner*—Zakiya W. Bates
(74) *Attorney, Agent, or Firm*—Winstead PC

(57) ABSTRACT

An hydraulic latch for selectively securing and, when necessary, automatically releasing capillary tubing suspended in a well bore in a manner affording clearance of a subsurface safety valve through which the suspended capillary tubing is suspended prior to release.

30 Claims, 4 Drawing Sheets

U.S. PATENT DOCUMENTS

| | | | |
|---|---|---|---|
| 5,944,111 | A | 8/1999 | Bridges |
| 6,000,469 | A | 12/1999 | Bassinger |
| RE36,723 | E | 6/2000 | Moore et al. |
| 6,089,338 | A | 7/2000 | Bouligny, Jr. |
| 6,192,981 | B1 | 2/2001 | Boquet et al. |
| 6,484,808 | B2 | 11/2002 | Jones et al. |
| 6,543,546 | B2 | 4/2003 | Kaiser |
| 6,588,502 | B2 | 7/2003 | Nice |

OTHER PUBLICATIONS

Double-E Inc.; "Leak Sensor", Product Sheet, 1991, 1 page.
Double-E Inc,; "Production Blowout Preventer LP-15"; Product Sheet, 1 page.
Double-E Inc.; "Flapper Valve"; Product Sheet, 1 page.
Double-E Inc.; "Polished Rod Lubricator"; Product Sheet, 1 page.

* cited by examiner

HYDRAULIC LATCH FOR CAPILLARY TUBING STRING

BACKGROUND OF THE INVENTION

1. Field of Invention

The present invention relates to an hydraulic latch for a small diameter tubing string suspended beneath a wellhead and, more particularly, but not by way of limitation, to a system for and method of selectively securing and, when necessary, releasing capillary tubing suspended in a well bore in a manner affording automatic release in an emergency situation to maintain the reliability of a subsurface safety valve through which the suspended tubing passes.

2. History of Related Art

A modern practice in the oil and gas industry is the use of small diameter tubing to deliver select chemicals down a well bore. Typically, devices are used at the wellhead to confine pressure in the well around the tubing suspended therein. By using such techniques, the production rates from natural gas wells, otherwise adversely affected by corrosion and the buildup of such substances as scale, paraffin and salt, can be improved. Prior to such innovation, producers traditionally treated the wells by inserting chemicals and soap sticks at the wellhead and relying on gravity to carry the treating agent down the well to where it was needed. However, with small diameter tubing inserted into the well, the treating chemical may be pumped down the well. Such tubing is generally referred to as capillary tubing, which is usually ¼, ⅜ or ⅝ inch in diameter. The chemical is pumped under pressure down the capillary tubing and allowed to enter the well where it can do the most good. A check valve at the lower end of the tubing controls the release of the treating chemical and prevents well pressure from escaping up the capillary tubing.

Current wellhead systems taking advantage of capillary tubing techniques generally utilize packoffs for controlling the capillary tubing being inserted at the wellhead. There are many varieties, but one system is set forth and shown in U.S. Pat. No. 6,955,225 issued Oct. 18, 2005, assigned to the assignee of the present invention. This patent illustrates control mechanisms for capillary tubing securement as well as means for quickly regaining control of tubing within a wellhead that has, for one reason or the other, not been secured by conventional securing systems. Reliability and safety are integral elements of an effective wellhead system. Other critical aspects of the wellhead system include the ability of the wellhead equipment and systems to prevent the uncontrolled release of gas, hydrocarbons, and/or other products from within the underlying wellbore in the event of an emergency. Emergencies can occur through natural disaster, sabotage, breakdown in equipment, and/or related events which cause an interruption in the existing securement or sealing system of the wellhead and/or wellbore.

The prevention of a blowout is so critical that safety valves are disposed downhole. Such safety valves are disposed within the borehole to facilitate an automatic sealing of the borehole in a manner for getting the release of gas, hydrocarbons and/or other substances within the borehole that are typically under pressure in the event of such an emergency. The problem exists with such downhole safety valves when capillary tubing and the like is suspended down the wellbore. It can be readily understood that a valve would be unable to seal effectively if tubing were extending therethrough. In such an event, the absence of effective valve sealing would most likely result in the release of the gas and/or hydrocarbons due to the fact that the integrity of the sub-surface safety valve has been compromised.

For the above-mentioned reasons, a reliable method of and apparatus for tubing release above a sub-surface safety valve is greatly needed. Such a method and apparatus must be of the type that can be quickly activated with reliable effectiveness in the event of an emergency. The present invention provides a means for and method of quickly releasing tubing within a borehole above a sub-surface safety valve without the need for operator intervention. In this manner, sabotage, natural disaster, or other unforeseen emergencies at the wellhead can result in the release of the tubing that stands to potentially interfere with the sub-surface safety valve therein providing a fail-safe mechanism to seal off a borehole in such an event.

SUMMARY OF THE INVENTION

The present invention relates to a suspendable tubing latch adapted for coupling a lower length of capillary tubing in place relative to an upper length of capillary tubing from which the tubing latch is suspended inside a borehole. More particularly, the present invention relates to a system and method for securing the lower length of capillary tubing within a tubing latch that is hydraulically activated to maintain securement of the lower length of capillary tubing relative to an upper length capillary tubing from which the tubing latch is suspended and from which depressurization will result in the release of the lower length of capillary tubing and its passage through the sub-surface safety valve to permit the unimpeded, fail-safe operation thereof.

In another aspect, one embodiment of the present invention relates to the use of a deformable spacer within an hydraulic piston assembly of the above-described tubing latch which effectively creates a release mechanism responsive to depressurization of the hydraulic fluid. More particularly, but not by way of limitation, the above described tubing latch may include a piston cylinder arrangement in which upper slips secure an upper capillary tubing section relative to a lower capillary tubing section secured by slips held in place by a first mechanical piston securement utilizing a deformable spacer and an hydraulic system that maintains the mechanical pressure during the deformation of the deformable spacer. In this manner, the release of hydraulic pressure results in the release of the slips on the lower capillary tubing to result in the unlatching of the lower capillary tubing so that it may descend beneath the sub-surface safety valve for the effective operation of said valve.

In another aspect, the present invention provides means whereby well bore capillary tubing will not interfere with the normal operation of a sub-surface safety valve. This is accomplished by a tubing latch, or coupling, that joins two segments of the capillary tubing together. The tubing latch is suspended just above the sub-surface safety valve by a length of capillary tubing that is attached to the surface packoff. A separate piece of tubing extends from the lower end of the tubing latch, passes through the safety valve and down to the desired depth in the well. In the event of an emergency, the tubing latch releases the lower length of capillary tubing. That allows the lower segment of capillary tubing to fall through the safety valve leaving the valve's bore free of obstacles.

In yet another aspect, the tubing latch described above has a plurality of slips that grip the outside diameter of the lower length of capillary tubing. These slips are kept in tight engagement with the capillary tubing by a hydraulic piston. A separate control line conveys pressure from the surface and keeps the piston energized during normal well operations. Any abnormal condition resulting in loss of hydraulic pressure will release the lower length of capillary tubing.

In one aspect, the above-referenced control line may consist of small diameter tubing. It is easier and thus more desirable to insert the control line into the well if it is not pressurized until the tubing has been lowered to its desired depth. So initially the tubing latch must hold the lower length of capillary tubing without the aid of hydraulic pressure. Only after the final depth has been reached is the control line pressurized. The pressure must then be maintained to keep the lower length of capillary tubing suspended from the tubing latch. A loss of pressure causes the lower segment of capillary tubing to be released.

In yet a further aspect, one embodiment of the invention incorporates a mechanical latch to initially hold the lower capillary tubing securely within the tubing latch until it reaches the desired depth, then pressurizing a control line that energizes a hydraulic latch which overrides the mechanical one to afford fail-safe operation as described herein.

In yet a further aspect, a tubing latch is provided for selectively coupling and decoupling upper and lower sections of small diameter tubing suspended within a well bore. The latch is disposed above a subsurface-safety valve through which the lower tubing section passes when coupled to the upper tubing. The tubing latch comprises a housing formed of a plurality of axially aligned latch elements having an axial bore disposed therethrough for securement of the upper and lower tubing sections therein. An upper housing assembly is adapted to secure the upper tubing section with first means slidably coupled into the upper housing for frictionally restraining movement of the upper tubing section. A lower housing assembly is adapted to releasably secure the lower tubing section with second means slidably coupled into the lower housing for frictionally restraining movement of the lower tubing section. Mechanical-hydraulic means are also provided for urging the slidable coupling of the second means such that mechanical action secures the lower tubing section in a first mode and hydraulic action secures the lower tubing section in a second mode, and wherein the second mode of securement allows the decoupling of the lower tubing section in the event of select hydraulic depressurization to permit the lower tubing section to drop below the subsurface-safety valve.

BRIEF DESCRIPTION OF THE DRAWINGS

The present invention will now be described in more detail with reference to preferred embodiments of the present invention, given only by way of examples, and illustrated in the accompanying drawings in which.

DETAILED DESCRIPTION

As discussed above, capillary tubing strings are normally suspended from a device at the surface which has slips or a clamp to grip the tubing string. The surface device also provides a means of sealing around the outside diameter of the tubing. These capillary tubing packoffs are the primary, and usually only, means of containing the well pressure.

If the surface packoff is damaged or destroyed, a blowout of the well may occur. Such damage to the packoff could result from a natural disaster or from sabotage. To guard against this, a well operator may want to install a sub-surface safety valve. Under normal circumstances the safety valve remains open so that gas produced by the well may flow to the surface. In the event of an emergency, the valve automatically closes to contain the well pressure.

One way to accomplish this is to employ hydraulic pressure to keep the valve open. A control line conveys pressure from a surface pump or accumulator down to the valve. This pressure forces the valve to remain open under normal well conditions. If there is a loss of hydraulic pressure at the surface or in the control line, a spring automatically closes the valve. Valves that operate in this mode are deemed to be "fail-safe" and are commonly used in the industry.

The capillary tubing is inserted into the inside of the production string (pipe) of a gas well. As such, the capillary tubing must pass through a sub-surface safety valve, which could prevent the valve from closing properly.

It has thus been discovered that a tubing latch 10 adapted for coupling capillary tubing 11, and in particular securing upper and lower lengths of capillary tubing 11A and 11B, respectively, within a well bore and above a subsurface safety valve and providing the release of the lower capillary tubing therefrom and consequently away from the subsurface safety valve in the event of an emergency may enhance the operational safety and efficiencies surrounding the use of capillary tubing in a wellbore.

Figure 1:
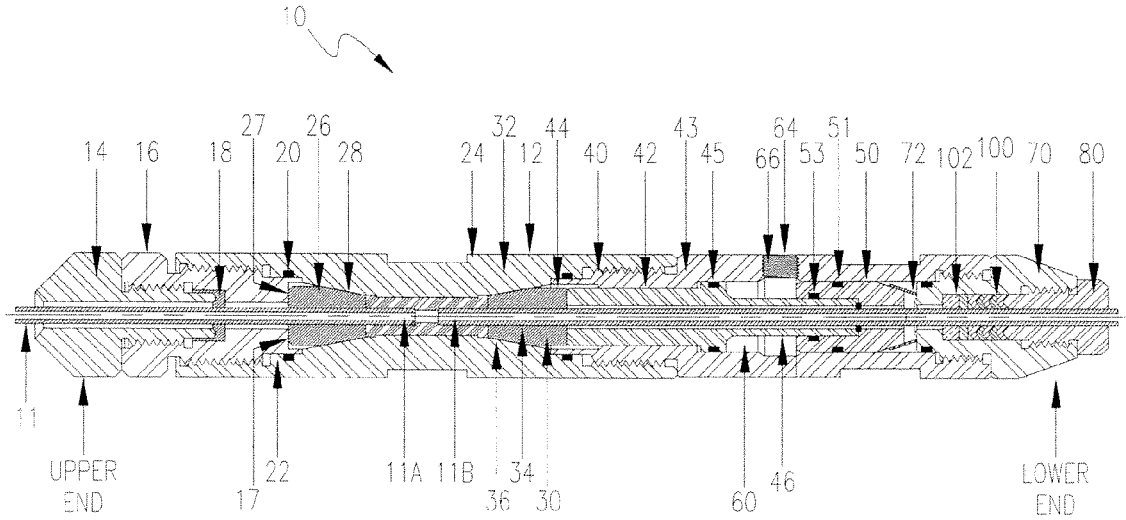
FIG. 1 is a side elevational cross-sectional view of one embodiment of the tubing latch incorporating the principles of the present invention.

Referring now to FIG. 1, there is shown a side elevation cross-sectional view of tubing latch 10 for coupling capillary tubing 11. The tubing latch 10 comprises the end closest to the wellhead. The lower end, nearer to a subsurface safety valve is also so labeled. Thus oriented for this description, it may be seen that housing 12 comprised of multiple, axially aligned elements assembled one to the other. Housing 12 includes seal activator 14 disposed atop and threadably coupled to top plug 16. A grommet seal 18 is disposed beneath the top plug 16, between the seal activator 14 and an intermediate region of the top plug 16. Likewise, an O-ring 20 is disposed around the top plug 16 at a lower end 22 thereof. Other O-ring members are indicated within these figures to illustrate one embodiment of sealing assemblies and it should be noted that other O-ring location, assemblies and numbers may be utilized in accordance with the spirit and scope of the present invention.

Still referring to FIG. 1, a guide 24 is provided in threaded engagement with the top plug 16 and engages the O-ring 20 therearound. Slips 26 having upper ends 27 are disposed within the guide 24 and positioned along conical inner surface 28 thereof. The bottom 17 of plug 16 abuts upper ends 27 for applying pressure thereto. A second pair of slips 30 are disposed in a lower section 32 of the guide 24 in an axial bore 34 having conical sidewalls 36 formed therearound.

Still referring to FIG. 1, a cylinder 40 is threadably coupled to the guide 24 and contains a slip piston 42 therein. The slip piston is adapted for abutting the lower end 44 of the lower slips 30, applying pressure and causing the slips 30 to engage the conical sidewalls 36 of the lower section 32 of the guide 24. This engagement is similar to the engagement and pressure exerted by the top plug 16 against the upper ends 27 of the upper slips 26. An O-ring 45 is likewise disposed around an intermediate collar region 43 of the slip piston 42 to provide sealing relative to the cylinder 40 as described below. The lower region 46 of the slip piston 42 comprises an elongate neck portion of reduced diameter that extends downwardly into engagement with a seal piston 50. The seal piston 50 likewise includes a first O-ring 51 allowing its sealed engagement relative to the lower portion of cylinder 40 and a second O-ring 53 allowing its sealed engagement relative to the lower region 46 of slip piston 42, thereby forming an annular region 60 thereabove and beneath O-ring 45 for the containment of pressurized hydraulic fluid. An hydraulic access port 64, which is shown with threads 66, in this particular embodiment, provides coupling and access for hydraulic fluid to be pumped under pressure into the annular recess 60.

Still referring to FIG. 1, the seal piston 50 is disposed axially above by a bottom plug 70 and spaced therefrom by a deformable spacer 72 disposed therebetween. Finally, a bottom gland 80 is disposed at the lower distal end of the tubing latch 10 and threadably engages the bottom plug 70. The threadable engagement between the bottom gland 80 and the bottom plug 70 permits pressure to be exerted upon a V-packing 100 comprising V-packing support 102 and V-packing seal rings 104 described below.

Figure 2:
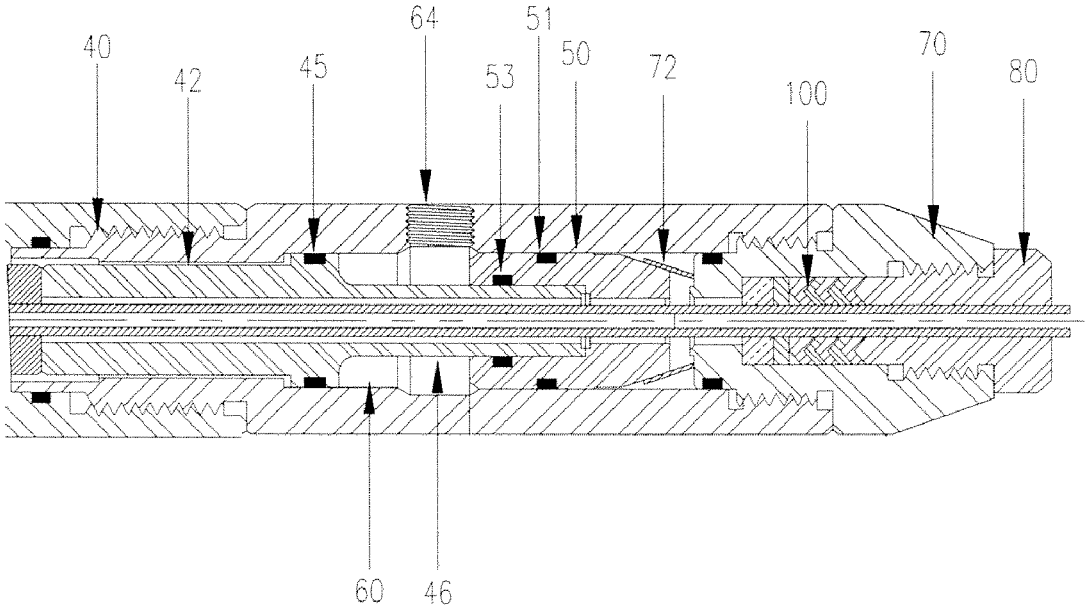
FIG. 2 is an enlarged, side elevational, cross-sectional view of the lower section of the tubing latch of FIG. 1.

Referring now to FIG. 2, there is shown an enlarged, side elevational, cross-sectional view of the lower section of the tubing latch 10 which surrounds capillary tubing 11 extending therethrough. Shown more clearly in this enlarged view is V-packing 100 and V-packing support 102 disposed between the bottom gland 80 and bottom plug 70. The V-packing support 102 comprises a first elastomeric member which is combined with the seal rings 104. The V-packing 100 thus affords sealable engagement of the capillary tubing 11 extending therethrough. The sealable engagement does not, however, provide the level of engagement necessary for support of the capillary tubing within a wellbore, which support is derived by the slips 32 disposed thereabove.

Figure 3:
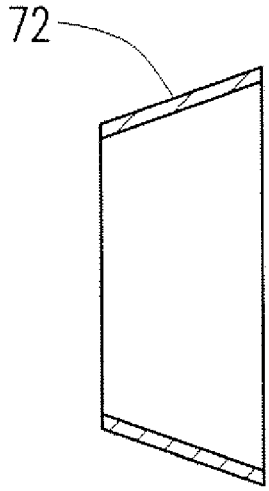
FIG. 3 is an enlarged, side elevational, cross-sectional view of the deformable spacer of FIGS. 1 and 2.

Referring now to FIG. 3, the deformable spacer 72 is formed, in this particular embodiment, of carbon steel. In operation, the mechanical assembly of the various above-described elements of the latch 10 provide securement of upper tubing 11A and lower capillary tubing 11B secured within the tubing latch 10. The mechanical securement is provided by the pressure exerted initially upon the slips as described above. Axial pressure on the lower slips 30 is initially provided through the slip piston 42 bearing against the seal piston 50 and bottom plug 70 which urges the slip piston 42 upwardly through its engagement with deformable spacer 72. The destruction of the deformable spacer 72 occurs only after the mechanical securement of the lower capillary tubing 11B through the axial force generated by the threaded engagement described above. Once the mechanical securement has been effected, hydraulic fluid is injected, under pressure, through port 64 to impart pressure with annular region 60. The pressure then continues to urge the slip piston 42 upwardly against the slips 30 and additional pressure ultimately results in the axially downward movement of the seal piston 50 toward the bottom plug 70 therein expanding and deforming the deformable spacer 72. Once the deformable spacer 72 has been expanded (as shown in FIG. 4) and the seal piston 50 has moved closer to the bottom plug 70, the upward pressure from the seal piston 50 against the slip piston 42 will have been removed and effectively replaced by the hydraulic pressure.

Figure 4:
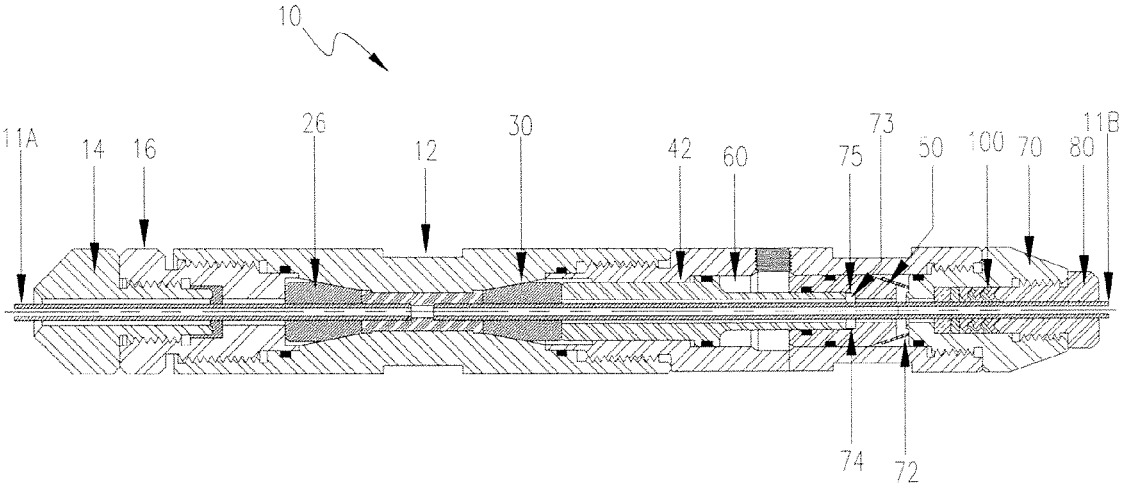
FIG. 4 is a side elevational, cross-sectional view of the tubing latch of FIG. 1 with the deformable spacer in the expanded, deformed condition.

Referring now to FIG. 4, there is shown the spacer 72 in receipt of the tapered section of the seal piston 50 therein. The spacer 72 is thus expanded. In this manner, the release of hydraulic pressure, due to an emergency at the wellhead, will therein cause the slip piston 42 to no longer be urged against the slips 30 and the weight of the lower capillary tubing section 11B pulling downwardly thereupon will urge the slips 30 to move downwardly and outwardly from the conical sidewalls 36 of the guide 24 thereby releasing the lower capillary tubing 11B therefrom and allowing the weight of the lower capillary tubing 11B to carry the capillary tube section downwardly from the tubing latch 10. In this manner, the capillary tubing 11B suspended within a wellbore is allowed to pass under its own weight through any sub-surface valve disposed beneath the tubing latch 10.

Referring now to FIGS. 3 and 4 in combination, the plastic deformation of the deformable spacer 72 must be specifically effectuated. The deformation must, however, be substantially plastic in that elastic deformation could result in the reestablishment of some of the space through which the sealed piston has moved. It is critical that when the seal piston deforms the deformable spacer 72, the deformation be permanent and a gap be created between the seal piston and the lower region 46 of the slip piston. Only in this way will the slip piston not be supported by the seal piston in the event of depressurization of hydraulic fluid from annular region 60. This spaced confirmation is shown most clearly in FIG. 4, as described in more detail below. Moreover, the deformable spacer 72 must yield in a predictable fashion and create the deformation described and shown. The design presented herein is a result of careful testing for providing an element that can withstand the mechanical pressure for imparting the necessary axial force to the lower slips 30 for securement of lower capillary tubing section 11B.

Referring now specifically to FIG. 4, the seal piston 50, when forced downwardly against the bottom plug 70 engages the deformable spacer causing it to expand to the taper configuration shown therebetween. The deformable spacer thus expands in plastic deformation outwardly into the generally tapered engagement with the seal piston 50 to allow the seal piston 50 to generally abut the top of the bottom plug 70 thereby creating a space 73 therein shown. It is this space 73 between the slip piston and the seal piston 50 that permits the slip piston 42 to move downwardly out of engagement with the lower slips 30 to allow the lower capillary tubing section 11B to egress from the latch 10 when hydraulic pressure drops below the second threshold.

Still referring to FIG. 4, the seal piston 50 is moved axially toward the bottom plug 70 after the application of sufficient hydraulic pressure within annular region 60. This movement expands the conical deformable spacer 72 into the configuration generally shown. This particular configuration is a representative illustration of a deformable spacer 72 made from 1018 cold drawn carbon steel and experimentally tested under loading conditions. The design represents one embodiment of a deformable spacer 72 in accordance with the principles of the present invention. As shown herein, the gap created between the bottom end of the slip piston 42 and an upward facing shoulder 74 of a counter bore 75 in the seal piston 50 allows room for the slip piston to fall in the event of loss of hydraulic pressure below the second threshold. When the slip piston falls, it allows the slips to disengage and drop the capillary tubing string.

In summary, the above discussion relative to FIGS. 3 and 4 illustrate the operation of one embodiment of the present invention wherein a first, upper threshold pressure of hydraulic fluid within the annual region 60 creates the above-described plastic, expansive deformation of the deformable spacer 72. It is this upper threshold pressure that must be established in order to create the gap between the bottom end under the slip piston 42 and the upward facing shoulder 74 of the counter bore 75 in the seal piston 50 which allows room for the slip piston to fall in the event of the loss of hydraulic pressure below the second threshold. The second lower threshold pressure is that minimum pressure which maintains the slip piston 42 in engagement with the lower slips 30 within the latch 10 for securement of the lower tubing section 11B therein. It should thus be observed that the establishment of the necessary first, upper hydraulic pressure thresholds and maintenance of said pressure above the second lower threshold pressure must be carefully defined and carefully implemented relative to the operation of the latch 10 of the present invention in order to create first and second modes of mechanical-hydraulic urging of the lower slips 30 which comprise a slidable coupling of the latch 10. In other words, the mechanical-hydraulic means for urging the slidable coupling of the lower slips 30 are such that mechanical action secures the lower tubing section 11B in a first mode without the application of any hydraulic pressure and, upon the generation of hydraulic pressure within the annular region 60, the hydraulic action secures the lower tubing section 11B in a second mode due entirely to the hydraulic pressure. This level of second mode securement will continue as long as the hydraulic pressure continues above the second, lower threshold pressure, below which the elimination of sufficient hydraulic pressure permits the lower tubing section 11B to drop out of the latch 10 and below the above-referenced sub-surface safety valve within the well bore.

For purposes of example, experimental data has shown that a preferred embodiment includes mechanically securing the capillary tubing latch 10 as described above and suspending the mechanically-secured latch 10 within the well bore with the capillary tubing depending therefrom prior to hydraulic pressurization. Upon reaching the desired depth, it has been found that a pressurization of on or about 5500 psi held for one minute accomplishes the first, upper threshold pressure for expansive deformation of the deformable spacer 72 above described. In this particular test, the pressure of on or about 5500 psi was held for one minute and reduced to 3500 psi and maintained during normal conditions. In that particular test configuration, a second, lower pressure threshold was established at 2500 psi at which point, the pressure upon the slips 30 was sufficiently low to allow disengagement of the slips 30 from around the capillary tubing 11B for its release downwardly through the subsurface safety valve.

Although various embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth herein.

We claim:

1. A tubing latch for selectively coupling and decoupling upper and lower sections of small diameter tubing suspended within a well bore, said latch being disposed above a subsurface-safety valve through which said lower tubing section passes when coupled to said upper tubing, said tubing latch comprising:

a housing formed of a plurality of axially aligned latch elements having an axial bore disposed therethrough for securement of said upper and lower tubing sections therein;

an upper housing assembly adapted to secure said upper tubing section;

first means slidably coupled into said upper housing for frictionally restraining movement of said upper tubing section;

a lower housing assembly adapted to releasably secure said lower tubing section;

second means slidably coupled into said lower housing for frictionally restraining movement of said lower tubing section; and mechanical-hydraulic means for urging said slidable coupling of said second means such that mechanical action secures said lower tubing section in a first mode and hydraulic action secures said lower tubing section in a second mode, and wherein said second mode of securement allows said decoupling of said lower tubing section in the event of select hydraulic depressurization to permit said lower tubing section to drop below said subsurface-safety valve.

2. The tubing latch as set forth in claim 1 wherein the small diameter tubing comprises capillary tubing.

3. The tubing latch as set forth in claim 1 wherein said upper and lower housing assemblies secure said upper and lower tubing sections in generally axially aligned spaced relationship one to the other.

4. The tubing latch as set forth in claim 3 wherein said upper and lower housing assemblies secure said upper and lower tubing sections with upper and lower tubing sections with upper and lower slip assemblies generally axially aligned one with the other.

5. The tubing latch as set forth in claim 4 wherein said upper slip assembly comprises a plurality of slips secured in position by mechanical securement means.

6. The tubing latch as set forth in claim 5 wherein said upper housing assembly includes an elongate guide having an upper portion in threaded receipt of a top plug therein adapted to provide axial force against said upper slips for the securement of said upper tubing section therein.

7. The tubing latch as set forth in claim 6 wherein said lower housing assembly includes a lower section of said elongate guide and a slip piston adapted to provide an axial bearing force against said lower slips for selectively securing and unsecuring said lower section of said tubing therein.

8. The tubing latch as set forth in claim 7 wherein said slip piston is adapted for securing said lower tubing section in said first mode by mechanical engagement of axially aligned latch elements.

9. The tubing latch as set forth in claim 8 wherein said mechanical engagement comprises threaded engagement between at least two of said axially aligned latch elements.

10. The tubing latch as set forth in claim 9 wherein said slip piston is adapted to secure said lower slips in engagement with said lower capillary tubing section by hydraulic securement means in said second mode.

11. The tubing latch as set forth in claim 9 and further including a seal piston reciprocally mounted in a slip piston cylinder secured to said lower portion of said guide and assembled to provide a said axial mechanical force against said slip piston for securing said lower capillary tubing section with said slips and further being axially disposed within said slip piston cylinder by a deformable spacer disposed between said slip piston and a bottom plug adapted for mechanical engagement with said slip piston cylinder for the generation of said axial mechanical force thereagainst for urging said slip piston into engagement with said lower slips in said first mode.

12. The tubing latch as set forth in claim 11 and further including said slip piston being formed with an elongate reduced neck region defining an annular space outwardly therearound and inwardly of said slip piston cylinder for containing hydraulic fluid therein for imparting hydraulic force thereto to secure said slip piston in engagement with said lower slips for securement of said lower tubing section therein.

13. The tubing latch as set forth in claim 12 wherein said deformable spacer is adapted to provide sufficient axial support for said mechanical engagement of said slip pistons against said lower slips for securement of said lower tubing therein and for being crushed by said hydraulic pressure within said annular region when said hydraulic pressure exceeds a first hydraulic pressure threshold, whereby said deformable spacer deformation results in the axial movement of said seal piston toward said bottom plug and the elimination of mechanical support by said seal piston against said slip piston such that reduction of hydraulic force beneath a second hydraulic pressure threshold will result in the decoupling of said lower capillary tubing from said lower slips and the passage of said lower tubing beneath said tubing latch and below said subsurface-safety valve.

14. The tubing latch as set forth in claim 13, wherein said deformable spacer is generally conically shaped.

15. The tubing latch as set forth in claim 14, wherein said conically shaped spacer is formed from carbon steel.

16. The tubing latch as set forth in claim 15 wherein said carbon steel is 1018 cold drawn carbon steel.

17. A method of selectively coupling and decoupling upper and lower sections of small diameter tubing suspended above a subsurface-safety valve within a well bore with a tubing latch such that the lower section of tubing is suspended through said subsurface safety valve, said tubing latch comprising:

assembling a housing from a plurality of threadably connected latch elements formed with an axial bore therethrough adapted for receipt of said upper and lower tubing sections therein;

assembling a top plug in an upper housing assembly axially aligned with an upper section of an elongate guide containing a plurality of slips therein adapted to secure said upper tubing section therewith through the threaded engagement of said top plug and said upper section of said elongate guide therebetween;

forming a lower housing assembly of a lower section of said elongate guide and providing, a slip piston cylinder threadably connected thereto with a slip piston reciprocally mounted therein, and a seal piston disposed within said slip piston housing and in axial engagement with said slip piston for mechanically urging said slip piston into engagement with a plurality of slips disposed thereagainst for securing said lower section of capillary tubing therein;

forming said slip piston for urging said lower slips into engagement with said lower section of small diameter tubing by axial mechanical force from said seal piston in a first mode and by hydraulic actuation through the presence of hydraulic pressure within said slip piston cylinder in a second mode to therein allow select decoupling of said lower tubing section in the event of select hydraulic depressurization to therein permit said lower tubing section to drop below said subsurface-safety valve.

18. The method as set forth in claim 17 and including the step of providing the small diameter tubing in the form of capillary tubing.

19. The method as set forth in claim 17 and further including assembling said upper and lower tubing sections in generally axially aligned spaced relationship one to the other.

20. The method as set forth in claim 19 and further including the steps of securing said upper and lower tubing sections with upper and lower housing assemblies and upper and lower slip assemblies mounted therein.

21. The method as set forth in claim 20 and further including the step of assembling the upper slip assembly with a plurality of slips secured in position by a mechanical securement means.

22. The method as set forth in claim 21 and further including the step of assembling the upper housing assembly with an elongate guide having an upper portion in threaded receipt of a top plug therein adapted to provide axial force against said upper slips for the securement of said upper tubing section therein.

23. The method as set forth in claim 22 and further including assembling the lower housing assembly with a lower section of said elongate guide and a slip piston adapted to provide an axial bearing force against said lower slips for selectively securing and unsecuring said lower section of said tubing therein.

24. The method as set forth in claim 23 and further including adapting the slip piston for securing said lower tubing section in said first mode by mechanical engagement of axially aligned latch elements.

25. The method as set forth in claim 24 and further including providing mechanical engagement through threaded engagement between at least two of said axially aligned latch elements.

26. The method as set forth in claim 24 and further including the step of adapting the slip piston to secure said lower slips in engagement with said tubing section by hydraulic securement means in said second mode.

27. The method as set forth in claim 26 and further including forming said slip piston with an elongate reduced neck region defining an annular space outwardly therearound and inwardly of said slip piston cylinder for containing hydraulic fluid therein for imparting hydraulic force thereto to secure said slip piston in engagement with said lower slips for securement of said lower tubing section therein.

28. The method as set forth in claim 27 and further including the step of providing the deformable spacer in a configuration providing sufficient axial support for said mechanical engagement of said slip piston against said lower slips for securement of said lower tubing therein and for being crushed by said hydraulic pressure within said annular region when said hydraulic pressure exceeds a first hydraulic pressure threshold, whereby said deformable spacer deformation results in the axial movement of said seal piston toward said bottom plug and the elimination of mechanical support by said seal piston against said slip piston such that reduction of hydraulic force beneath a second hydraulic pressure threshold will result in the decoupling of said lower tubing section from said lower slips and the passage of said lower tubing section beneath said tubing latch and below said subsurface-safety valve.

29. The method as set forth in claim 28 and including the step of forming the spacer in a generally conical shape.

30. The method as set forth in claim 24 and further including reciprocally mounting the seal piston in the slip piston cylinder secured to said lower portion of said guide and assembled to provide a said axial mechanical force against said slip piston for securing said lower tubing section with said slips and further being axially disposed within said slip piston cylinder by a deformable spacer disposed between said slip piston and a bottom plug adapted for mechanical engagement with said slip piston cylinder for the generation of said axial mechanical force thereagainst for urging said slip piston into engagement with said lower slips in said first mode.

* * * * *